United States Patent [19]

Wendell

[11] Patent Number: 5,053,815

[45] Date of Patent: Oct. 1, 1991

[54] REPRODUCTION APPARATUS HAVING REAL TIME STATISTICAL PROCESS CONTROL

[75] Inventor: Michael J. Wendell, Webster, N.Y.

[73] Assignee: Eastman Kodak Company, Rochester, N.Y.

[21] Appl. No.: 506,307

[22] Filed: Apr. 9, 1990

[51] Int. Cl.[5] ..... G03G 21/00

[52] U.S. Cl. ..... 355/208; 355/308; 355/316

[58] Field of Search ..... 355/206, 208, 308, 316

[56] References Cited

U.S. PATENT DOCUMENTS

| | | | |
|---|---|---|---|
| 4,062,061 | 12/1977 | Batchelor et al. | 355/206 |
| 4,551,813 | 11/1985 | Sanbayashi et al. | 355/206 |
| 4,589,080 | 5/1986 | Abbott et al. | 355/208 X |
| 4,719,586 | 1/1988 | Moyer et al. | 364/552 |
| 4,735,366 | 4/1988 | Braswell et al. | 355/208 |
| 4,785,329 | 11/1988 | Walsh | 355/206 |

OTHER PUBLICATIONS

"Real-Time Data Acquisition using SPC" by William C. Kyde III & John Layden; from 10/1988 Manufacturing Eng. pp. 64–67.

*Primary Examiner*—R. L. Moses
*Assistant Examiner*—J. E. Barlow, Jr.
*Attorney, Agent, or Firm*—Milton S. Sales

[57] ABSTRACT

Document reproduction apparatus includes a plurality of sensors for acquiring real time diagnostic data. The acquired data is statistically compared to predetermined control limits or reference value(s) to predeict incipient problems before failure occurs so as to functionally and automatically optimize the reproduction apparatus. Operation of the document reproduction apparatus is functionally optimized in real time in response to differences between the acquired data and the predetermined control limits or reference value(s). The optimizing operation may be in response to detection that the acquired data is tending away from nominal by studying statistical variations in the data.

6 Claims, 4 Drawing Sheets

| FUNCTION | WAIT TIMES | | | |
|---|---|---|---|---|
| | SPECIFICATION RANGE | HIGH | LOW | AVERAGE |
| FEED PULSE TO PAPER-FED SENSOR 88 | XXX - XXX | XXX | XXX | XXX |
| PAPER-FED SENSOR 88 TO PLATEN-ENTRANCE SENSOR 90 | XXX - XXX | XXX | XXX | XXX |
| PLATEN-ENTRANCE SENSOR 90 TO REGISTRATION GATE SENSOR 92 | XXX - XXX | XXX | XXX | XXX |
| REGISTRATION GATE SENSOR 92 TO PLATEN-EXIT SENSOR 94 | XXX - XXX | XXX | XXX | XXX |
| PLATEN-EXIT SENSOR 94 TO POSTFLIP SENSOR 96 | XXX - XXX | XXX | XXX | XXX |
| POSTFLIP SENSOR 96 TO EXIT SENSOR 98 | XXX - XXX | XXX | XXX | XXX |
| | 100 | 102 | 104 | 106 |

FIG. 2

| FUNCTION | WAIT TIMES | | | |
|---|---|---|---|---|
| | SPECIFICATION RANGE | HIGH | LOW | AVERAGE |
| FEED PULSE TO WAIT SENSORS 46, 48, OR 70 | XXX - XXX | XXX | XXX | XXX |
| WAIT SENSOR 46, 48, OR 70 TO FED SENSOR 50 | XXX - XXX | XXX | XXX | XXX |
| WAIT SENSOR 48 TO VERTICAL TRANSPORT SENSOR 52 | XXX - XXX | XXX | XXX | XXX |
| VERTICAL TRANSPORT SENSOR 52 TO FED SENSOR 50 | XXX - XXX | XXX | XXX | XXX |
| FED SENSOR 50 TO VACUUM TRANSPORT SENSOR 54 | XXX - XXX | XXX | XXX | XXX |
| VACUUM TRANSPORT SENSOR 54 TO POST-FUSING SENSOR 56 | XXX - XXX | XXX | XXX | XXX |
| POST-FUSING SENSOR 56 TO SIDE EXIT SENSOR 60 | XXX - XXX | XXX | XXX | XXX |
| POST-FUSING SENSOR 56 TO "J" SENSOR 60 | XXX - XXX | XXX | XXX | XXX |
| "J" SENSOR 58 TO SIDE EXIT SENSOR 60 | XXX - XXX | XXX | XXX | XXX |
| SIDE EXIT SENSOR 60 TO TOP EXIT SENSOR 62 | XXX - XXX | XXX | XXX | XXX |
| TOP EXIT SENSOR 62 TO DUPLEX SENSOR 54 | XXX - XXX | XXX | XXX | XXX |
| DUPLEX SENSOR 64 TO DUPLEX SENSOR 66 | XXX - XXX | XXX | XXX | XXX |
| DUPLEX SENSOR 66 TO DUPLEX TRAY SENSOR 68 | XXX - XXX | XXX | XXX | XXX |
| | 72 | 74 | 76 | 78 |

FIG. 3

| FUNCTION | WAIT TIMES | | | |
|---|---|---|---|---|
| | SPECIFICATION RANGE | HIGH | LOW | AVERAGE |
| FEED PULSE TO PAPER-FED SENSOR 88 | XXX - XXX | XXX | XXX | XXX |
| PAPER-FED SENSOR 88 TO PLATEN-ENTRANCE SENSOR 90 | XXX - XXX | XXX | XXX | XXX |
| PLATEN-ENTRANCE SENSOR 90 TO REGISTRATION GATE SENSOR 92 | XXX - XXX | XXX | XXX | XXX |
| REGISTRATION GATE SENSOR 92 TO PLATEN-EXIT SENSOR 94 | XXX - XXX | XXX | XXX | XXX |
| PLATEN-EXIT SENSOR 94 TO POSTFLIP SENSOR 96 | XXX - XXX | XXX | XXX | XXX |
| POSTFLIP SENSOR 96 TO EXIT SENSOR 98 | XXX - XXX | XXX | XXX | XXX |
| | 100 | 102 | 104 | 106 |

REPRODUCTION APPARATUS HAVING REAL TIME STATISTICAL PROCESS CONTROL

BACKGROUND OF THE INVENTION

1. Technical Field

This invention relates generally to reproduction apparatus such as copiers and/or printers, and more particularly to the collection of data about the process and to the use of data drifts to predict incipient problems before failure occurs so as to functionally optimize the reproduction apparatus.

2. Background Art

Reproduction apparatus such as for example electrophotographic copiers and printers commonly include systems for monitoring various process parameters such as paper feed timing, temperatures, availability of consumables, etc. When a parameter exceeds its set point, the apparatus may be shut down for repairs, or, if the parameter is not critical to continued operation, an operator may be alerted to the need for maintenance or other action.

Reproduction apparatus is available wherein the apparatus itself triggers a call for service to a remote interactive center whenever a serious shutdown occurs which requires the attention of a repair person. Such apparatus is also able to record the number of occurrences of less serious shutdowns which can be serviced by an on-site key operator. The apparatus triggers a call for service when a predetermined number of these less serious shutdowns have been recorded. However, there is no system available for reproduction apparatus wherein pending change or failure is anticipated by real time statistical analysis of collected data.

3. Disclosure of Invention

It is an object of the present invention to provide real time information upon which the reproduction apparatus process corrections can be based by informing operators and others (either on site or off site) that some aspect of the process is drifting out of control before the apparatus actually malfunctions or produces unacceptable results.

It is another object of the present invention to provide real time statistical process control techniques to the operation of reproduction apparatus to detect incipient change or failure of the apparatus.

It is yet another object of the present invention to provide real time statistical process control techniques to the operation of reproduction apparatus such that a predetermined change in the standard deviation of data from a sensor will provide a signal that a change or failure is incipient.

It is another object of the present invention to provide real time statistical process control techniques to the operation of reproduction apparatus such that a predetermined statistical change of data from a sensor will provide a signal that a change or failure is incipient.

It is still another object of the present invention to provide real time statistical process control techniques to the operation of reproduction apparatus to detect incipient failure(s) of the apparatus and to provide for an automatic adjustment to return statistical stability to the apparatus.

It is another object of the present invention to provide real time statistical process control techniques to the operation of reproduction apparatus to detect a need of, and to provide for, automatic adjustment to return statistical stability to the apparatus; and to provide an indication that such automatic adjustment has been effected with sufficient frequency to indicate that failure beyond that which can be accommodated by automatic adjustment is incipient.

It is another object of the present invention to provide real time statistical process control techniques to the operation of reproduction apparatus to detect a need of, and to provide for, automatic adjustment to return statistical stability to the apparatus; and to provide for more frequent sampling as the number of such adjustments grows.

It is another object of the invention to provide for real time data acquisition, communication, analysis, and hardware for accomplishing the above objects.

In accordance with a preferred embodiment of the present invention, document reproduction apparatus includes a plurality of sensors for acquiring real time diagnostic data and means for comparing the acquired data to predetermined set points; statistical or otherwise. Operation of the document reproduction apparatus is functionally optimized in response to differences between the acquired data and the predetermined set points. The optimizing operation may be in response to detection that the acquired data is tending away from nominal by studying real time statistical variations in the data, or that the acquired data is tending away from nominal by comparing real time statistical deviations in the data to a reference value or values.

The invention and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIGS. 2 and 3 show examples of displays showing data collected from sensors in the apparatus of FIG. 1;

BEST MODE FOR CARRYING OUT THE INVENTION

The present invention relates to real time collection of data about processes in reproduction apparatus for the purposes of diagnostics and real time statistical process control so as to maximize apparatus up-time and to minimize unscheduled downtime. If a distribution spread and/or drift away from nominal machine operation begins to appear, the apparatus can be adjusted, a repair can be scheduled, the sampling rate can be increased, or other appropriate action taken. In general, the collection of data employs sensors already present in many commercially available products, or additional sensors may be added as required. The invention is not so concerned with the type data that is collected, but rather with the real time statistical process control of the reproduction apparatus based on the analysis of the data.

One example of the use of real time statistical process control is to diagnose paper handling operations by studying timing variations over several jobs for a sheet of paper to reach various sensors in the paper path of reproduction apparatus. The statistical results, say the standard deviation or drift of the variation, is compared to a reference value or values. When the standard deviation or drift exceeds a predetermined limit or limits, an adjustment flag or flags are set.

Response to the adjustment flag or flags may be a request for immediate correction by an operator, a request for a future correction during periodic scheduled service, or self correction (say of timing) by the apparatus software. The number of times an adjustment flag has been set may itself be statistically analyzed; and provides an indication of the probability that parts will fail. When that probability exceeds its predetermined limit, a second alarm flag is set so that appropriate repairs and/or replacements can be effected before failure. The response might be an increase in the sampling frequency.

Historical data and/or previous experience with a process will provide data on what statistical deviations or drifts are tolerable for the determination of adjustment or alarm values. Regional differences such as environmental effects may be taken into account when setting limits. Customer practices and needs may also be considered. For example, a customer who makes reproductions on inferior paper may find that the spread of the distribution of timing of paper feeds is different than the spread experienced by customers who use quality paper. In the case of users of inferior paper, a larger standard deviation would be expected, and not be an indication of machine malfunction.

On the otherhand, certain customers may be using apparatus for critical operations wherein long downtimes due to unexpected failures would be more costly in terms of lower productivity. Accordingly, the sampling rate might be higher for that customer than for typical operations.

Figure 1:
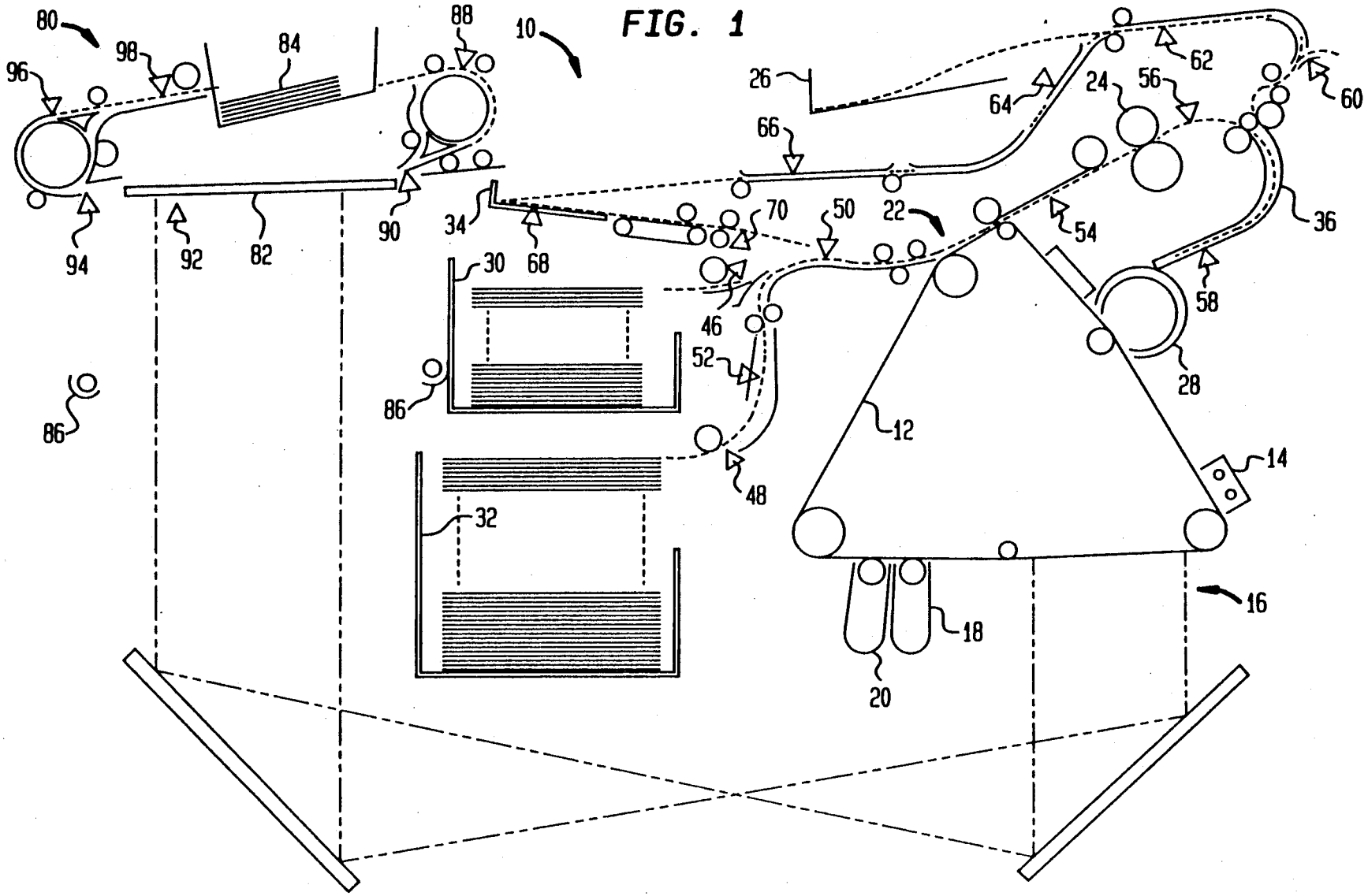
FIG. 1 is a schematic showing a side elevational view of an electrophotographic reproduction apparatus in accordance with a preferred embodiment of the invention.

In the illustrated embodiment of FIG. 1, an electrophotographic copier is shown as one example of reproduction apparatus. An image member 12, for example an electrophotographic web, moves through a series of electrophotographic stations which are well known in the art. Image member 12 is first charged by a charging station 14, exposed at an exposure station 16 to an optical image to create an electrostatic image. The electrostatic image is toned at one of toner stations 18 or 20 to create a toner image defined by the electrostatic image. At a transfer station 22, the toner image is transferred to a receiving sheet, which is fed to a fuser 24 where it is fixed. The receiving sheet may be then moved to a top output tray 26 or a side output tray (not shown). Image member 12 is cleaned at a cleaning station 28 and reused.

Fresh receiving sheets are stored in first supply 30 or second supply 32. An appropriate size receiving sheet can be fed from either supply to transfer station 22. If duplex copies are to be made, the receiving sheet is fed from fuser 24 through an inverting path to an intermediate tray 34. This deposits the receiving sheets in tray 34 with the image side up. If a number of copies are to be made of the same two images (or of different images in an automatic precollation mode) a substantial stack can be accumulated in intermediate tray 34. When the second side is to be imaged, the receiving sheets are fed from intermediate tray 34 from the bottom of the stack for presentation of the bottom side of the sheet to imaging member 12 at transfer station 22 to pick up the image for the opposite side. The sheet is then fed to an output tray with images on both sides.

If images of two different colors are to be placed on the same side of a receiving sheet, the receiving sheet receives the first image at transfer station 22, and is fused at fusing station 24 as described before. However, this receiving sheet is fed first through a "J" turnaround device 36 before following the path back to intermediate tray 34. Turnaround device 36 assures that the path from transfer station 24 back to intermediate tray 34 is a noninverting path and therefore the image is on the bottom of the sheets in intermediate tray 34.

When all of the first-color images have been transferred to the receiving sheets that are stacked in intermediate tray 34, the sheets are then fed from the bottom as before to transfer station 22 to receive the images of the different color to be added to the first images to the bottom side of the sheets. The sheets may then be fed to the output tray with two-color images on one side. With proper control of the apparatus, two-color images can be formed on both sides of the sheet without use of turnaround device 36 by doing one color on each side and then the other color on each side.

As set forth above, the present invention is concerned with the collection of data about various processes of the reproduction apparatus for the purposes of diagnostics and real time statistical process control to predict incipient problems before failure occurs so as to maximize apparatus up-time and to minimize unscheduled downtime. In order to fully explain the present invention, and as an example only, this specification will describe a system for collecting data about the receiving sheet feeding system.

The paper handling operations example of real time statistical process control studies timing variations over several jobs for a sheet of paper to reach various sensors in the paper path of reproduction apparatus. The statistical results, say the standard deviation or drift of the variation, is compared to a reference value. When the standard deviation or drift exceeds a predetermined limit, an adjustment or alarm flag is set.

Referring still to FIG. 1, a plurality of sensors are positioned around the path of the receiving sheets for detecting the presence of a sheet. A pair of wait sensors 46 and 48 detect paper from the upper and lower paper supplies 30 and 32, respectively. A paper fed sensor 50 detects registration feed, and a sensor 52 monitors vertical transport. A vacuum transport sensor 54 detects pre-fuser transport, and a post-transport sensor 56 checks paper in the cooler section. Sensor 58 is in "J" turnaround device 36. A sensor 60 monitors the side exit, and a sensor 62 monitors the top exit. A pair or duplex path sensors 64 and 66 check the path to intermediate tray 34, and a duplex tray sensor 68 detects paper presence in the intermediate tray. Finally, a sensor 70 is the wait sensor for paper fed from the intermediate tray.

FIG. 2 is a view of a display such as a print out or video screen showing some of the type of data available from the sensors around the paper path. It includes an indication 72 of the specification times for a sheet to go from one sensor position to the next, and indications 74, 76, and 78 of the greatest, least, and average times taken during the sample observation period. Statistical analysis of the high, low, and average values, when compared to the specification range can be used to trigger a flag set. For example, when the paper feed clutch starts to vary, it is desirable to effect repairs as soon as possible to avoid unscheduled outages. On the otherhand, one might permit a greater degree of variation before setting a flag if it were the toner concentration being monitored because a total shutdown is less likely to occur in that instance. Design engineers are best suited to determine the critical components of a system, and experience with the system over a period of time will permit fine tuning of the acceptable limits of variations.

Referring back to FIG. 1, a recirculating document feeder 80 is positioned on top of an exposure platen 82. Original documents are fed from a stack 84 to the platen for exposure by lamps 86. Turnaround paths are provided to copy the backs of the documents, and a by-pass path permits feeding singly sheet originals to the platen.

Recirculating feeder 80 is also provided with a plurality of paper sensors. Among those sensors is a paper-fed sensor 88, a platen-entrance sensor 90, a registration gate sensor 92, a platen-exit sensor 94, a postflip sensor 96, and an exit sensor 98.

FIG. 3 is a view of a display such as a print out or video screen showing some of the type of data available from the sensors in the document feeder. It includes an indication 100 of the specification times for a sheet to go from one sensor position to the next, and indications 102, 104, and 106 of the greatest, least, and average times taken during the sample observation period. Statistical analysis of the high, low, and average values, when compared to the specification range can be used to trigger a flag set.

While FIGS. 2 and 3 show some of the type of data which might be available from the sensors, those skilled in the art will understand that other types of information may be sensed or calculated to provide real time statistical process control. For example, one might be interested in standard deviations, mean values, high and low ranges, etc. The present invention is applicable to these and other data.

To carry out the control functions set forth above, the disclosed embodiment includes a control logic package which consists of control software, interface software, and logic hardware. The control logic package has a digital computer, preferably a microprocessor. The microprocessor has a stored program responsive to the input signals for sequentially actuating, then deactuating the work stations as well as for controlling the operation and timing of many other machine functions.

Programming of a number of commercially available microprocessors is a conventional skill well understood in the art. This disclosure is written to enable a programmer having ordinary skill in the art to produce an appropriate control program for the microprocessor. The particular details of any such program would, of course, depend on the architecture of the designated microprocessor.

Figure 4:
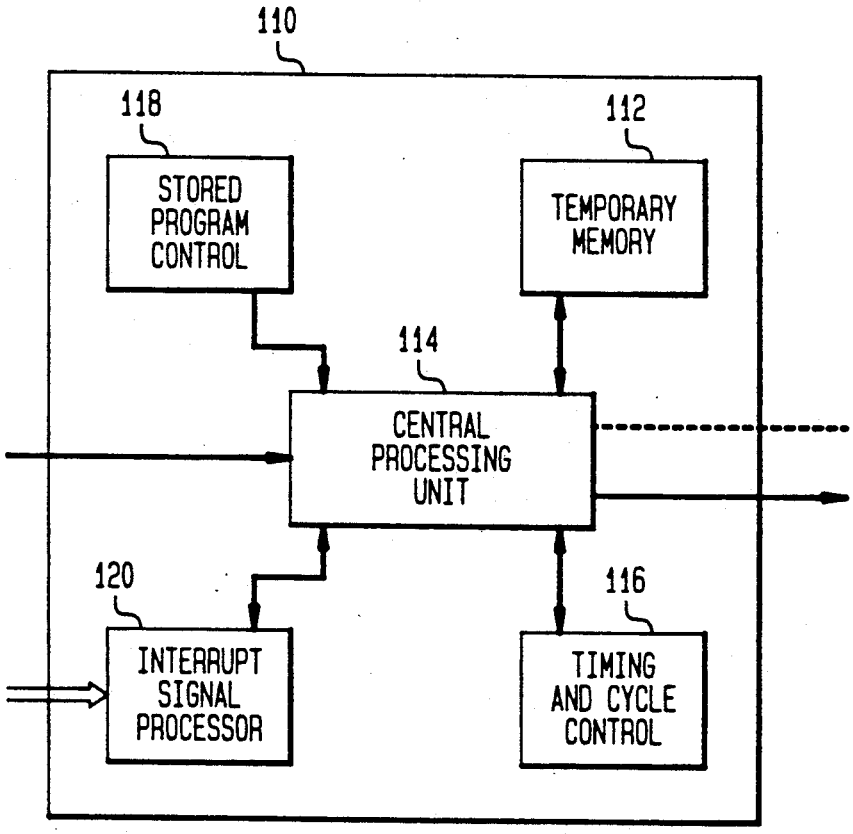
FIG. 4 is a block diagram of the logic and control unit for the apparatus of FIG. 1.

With reference now to FIG. 4, a block diagram of logic and control unit (control logic package) 110 consists of a temporary data storage memory 112, a central processing unit 114, a timing and cycle control unit 116, and a stored program control 118. Data input and output is performed sequentially under program control. Input data are received from sensors in the reproduction apparatus, and control signals are received through an interrupt signal processor 120. The input signals are derived from various switches, sensors, and analog-to-digital converters. The output data and control signals are applied to switches.

The invention has been described in detail with particular reference to preferred embodiments thereof, but it will be understood that variations and modifications can be effected within the spirit and scope of the invention. For example, the specification describes a system for collecting data about sheet feeding operations, but it will be understood that the present invention extends to the collection of data about other processes of the reproduction apparatus for the purposes of diagnostics and real time statistical process control to predict incipient problems before failure.

What is claimed is:

1. Document reproduction apparatus comprising:
a plurality of sensors for acquiring real time process diagnostic data;
means for statistically comparing the acquired data to at least one of predetermined control limits, specifications, and reference values;
control means responsive to statistical differences between the acquired data and the at least one of predetermined control limits, specifications, and reference values for functionally and automatically optimizing operation of the document reproduction apparatus in real time.

2. Document reproduction apparatus as set forth in claim 1 wherein said means for optimizing operation includes means for detecting when acquired data is tending away from nominal by studying real time statistical variations in the data.

3. Document reproduction apparatus as set forth in claim 1 wherein said means for optimizing operation includes means for detecting when acquired data is tending away from nominal by comparing real time statistical deviations in the data to at least one reference value.

4. Document reproduction apparatus comprising:
means for feeding sheets along a predetermined path;
a plurality of sensors along said path for acquiring process data relating to the arrival times of sheets at several positions along said path;
means for comparing the acquired data times to predetermined control limits;
control means responsive to differences between the acquired data times and the predetermined control limits for functionally and automatically optimizing operation of the document reproduction apparatus in real time.

5. Document reproduction apparatus as set forth in claim 4 wherein said means for optimizing operation includes means for detecting when acquired data times are tending away from nominal by studying real time statistical variations in the data times.

6. Document reproduction apparatus as set forth in claim 4 wherein said means for optimizing operation includes means for detecting when acquired data times are tending away from nominal by comparing real time statistical deviations in the data to a reference value.

* * * * *